US006012367A

United States Patent [19]

Westra et al.

[11] Patent Number: 6,012,367

[45] **Date of Patent: *Jan. 11, 2000**

[54] DOCUMENT TRIMMING APPARATUS

[75] Inventors: Michael A. Westra; Michael F. Baker, both of Grand Haven, Mich.

[73] Assignee: The Challenge Machinery Company, Grand Haven, Mich.

[ * ] Notice: This patent is subject to a terminal disclaimer.

[21] Appl. No.: 08/804,811

[22] Filed: Feb. 24, 1997

Related U.S. Application Data

[63] Continuation of application No. 08/324,807, Oct. 18, 1994, Pat. No. 5,694,823.

[51] Int. Cl.[7] ..... B26D 5/42; B26D 7/18

[52] U.S. Cl. ..... 83/147; 83/36; 83/99; 83/160; 83/167; 83/206; 83/277; 83/466; 83/468.7; 83/934; 83/452; 83/419; 83/421; 83/279; 83/708

[58] Field of Search ..... 83/206, 468.1, 83/468.6, 468.7, 451, 434, 461, 452, 418, 277, 279, 704, 705, 708, 419, 412, 411.7, 410.7, 147, 167, 466, 99, 58, 160, 467.1, 468.2, 36, 35, 421

[56] References Cited

U.S. PATENT DOCUMENTS

| | | | |
|---|---|---|---|
| 2,329,890 | 9/1943 | Fisher | 83/418 |
| 3,120,915 | 2/1964 | Horn et al. | 83/452 X |
| 3,125,140 | 3/1964 | Nichols | 83/438 |
| 3,146,650 | 9/1964 | Sarring et al. | 83/91 |
| 3,182,542 | 5/1965 | Cochran | 83/461 X |
| 3,546,990 | 12/1970 | Schneider | 83/206 X |
| 3,690,208 | 9/1972 | Muller | 83/934 X |
| 3,733,947 | 5/1973 | Bryson et al. | 83/934 X |
| 3,875,834 | 4/1975 | Vulcano . | |
| 4,445,409 | 5/1984 | Mohr et al. | 83/157 |
| 4,506,571 | 3/1985 | Jensen et al. . | |
| 4,850,257 | 7/1989 | Mohr | 83/93 |
| 5,117,554 | 6/1992 | Grabow | 83/451 X |
| 5,127,294 | 7/1992 | Mohr | 83/206 |
| 5,150,647 | 9/1992 | Mohr | 83/468.1 X |
| 5,156,515 | 10/1992 | Charron et al. | 83/912 X |
| 5,400,652 | 3/1995 | Harr | 83/206 X |
| 5,694,823 | 12/1997 | Westra et al. | 83/147 |

FOREIGN PATENT DOCUMENTS

| | | |
|---|---|---|
| 0242763A2 | 10/1987 | European Pat. Off. . |
| 0429941A3 | 6/1991 | European Pat. Off. . |
| 2911473A1 | 9/1980 | Germany . |
| 3931349A1 | 5/1990 | Germany . |

OTHER PUBLICATIONS

Exhibit A is a product brochure entitled "Champion Three Knife Trimmer," published in Jul. 1982, by The Challenge Machinery Co., Grand Haven, MI, assignee of the present patent application, which discloses a three knife trimmer.

*Primary Examiner*—Rinaldi I. Rada
*Assistant Examiner*—Boyer Ashley
*Attorney, Agent, or Firm*—Price, Heneveld, Cooper, DeWitt & Litton

[57] ABSTRACT

A document trimming apparatus includes a document trimming mechanism and a document positioning mechanism. The document trimming mechanism includes a trimmer clamp for holding a document made up of a stack of sheets while being trimmed and a knife for trimming an edge of the stack of sheets. The document positioning mechanism includes a transport holder for securely holding the stack of sheets during transport and further includes a carrier movably supporting the transport holder for translational and rotational movement relative to the document trimming mechanism. The document positioning mechanism is adapted to position successive edges of the stack of sheets proximate the knife for trimming. The document positioning mechanism includes a first actuator to control rotational movement, a second actuator to control translational movement, and a third actuator to control a side block for initial positioning of the stack on the document positioning mechanism. A controller is operably connected to the document trimming mechanism and the document positioning mechanism including the actuators to control the sequence of operations. The actuators include stepper motors to control angular rotation and the distance of translation.

22 Claims, 9 Drawing Sheets

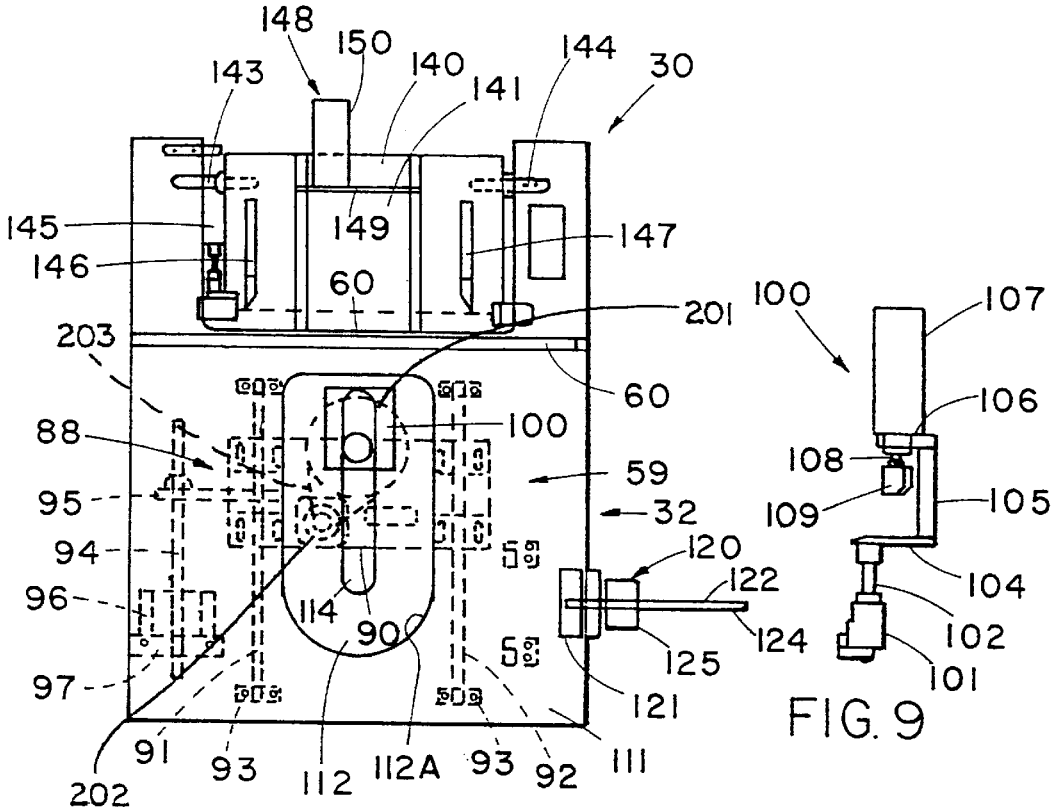
FIG. 6
FIG. 9
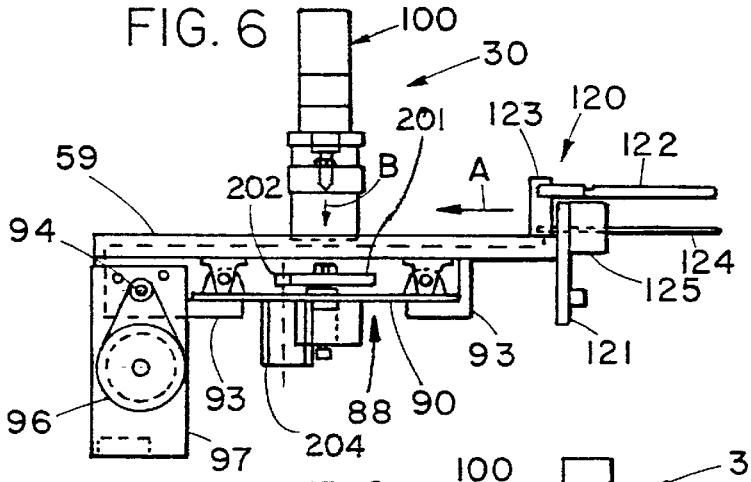
FIG. 7
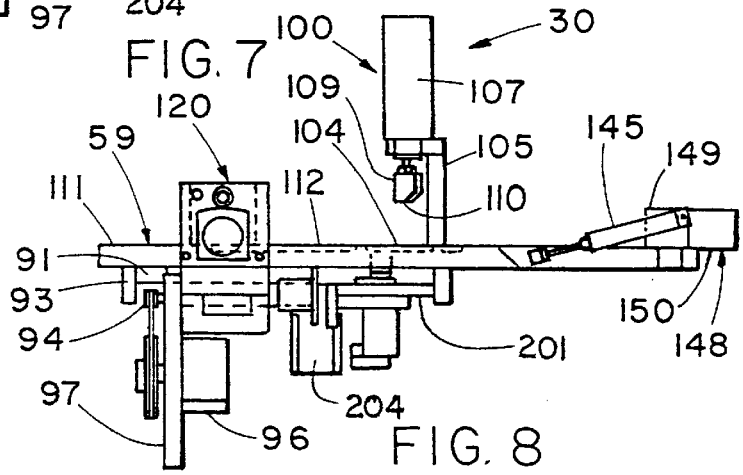
FIG. 8

DOCUMENT TRIMMING APPARATUS

This is a continuation application of prior application Ser. No. 08/324,807, filed on Oct. 18, 1994, and entitled DOCUMENT TRIMMING APPARATUS, now U.S. Pat. No. 5,694,823.

BACKGROUND OF THE INVENTION

The present invention relates to document trimming apparatus, and more particularly relates to a document trimming machine having a mechanism for positioning a document for trimming.

Document trimming machines typically include a guillotine-type trimming knife configured to trim an edge of a document to provide an attractive and neat appearance. Either the stack of paper must be repeatedly manually positioned and trimmed, or multiple knives must be used to trim multiple sides of the stack. However, repositioning of the stack can cause the stack to skew, such that the first trimmed edge becomes uneven before the remaining edges are trimmed. If multiple knives are used, the machine becomes complex. Also, machines that include multiple knives are difficult to adjust. Still further, safety is a concern in all trimming machines since it is relatively easy for an operator to accidentally position his or her finger in an unsafe position on the document during the trimming operation.

Thus, a document trimming apparatus solving the aforementioned problems is desired.

SUMMARY OF THE INVENTION

In one aspect, the present invention includes a document trimming apparatus including a document trimming mechanism having a trimmer clamp for holding a document while being trimmed and a knife defining a cutting line for trimming an edge of the document. The document trimming apparatus further includes a document positioning mechanism having a transport holder for securely holding the document during transport and a carrier movably supporting the transport holder for translational and rotational movement relative to the document trimming mechanism. The document positioning mechanism is adapted to position successive edges of the document proximate the cutting line for trimming. In a preferred form, the document trimming apparatus includes actuators operably connected to the document positioning mechanism for motivating the document positioning mechanism, and a controller for controlling the actuators.

In another aspect, a method of trimming a document includes providing a trimmer defining a cutting line and a clamp for holding the document, clamping the document with the clamp to hold the document, positioning a first edge of the stack of sheets at the cutting line, and trimming the first edge with the trimmer. The method further includes rotating and translating the stack of sheets while the clamp is still holding the document to position a second edge of the stack of sheets at the cutting line, and trimming the second edge with the trimmer.

These and other features and advantages of the present invention will be further understood and appreciated by those skilled in the art by reference to the following specification, claims and appended drawings.

BRIEF DESCRIPTION OF THE DRAWINGS

FIG. 6 is a plan view of the document positioning mechanism of the document trimming apparatus shown in FIG. 1;

FIG. 7 is a front view of the document positioning mechanism shown in FIG. 6;

FIG. 8 is a side view of the document positioning mechanism as shown in FIG. 6;

FIG. 9 is a side view of the rotating head shown in FIG. 8;

DETAILED DESCRIPTION OF THE PREFERRED EMBODIMENT

Figure 1:
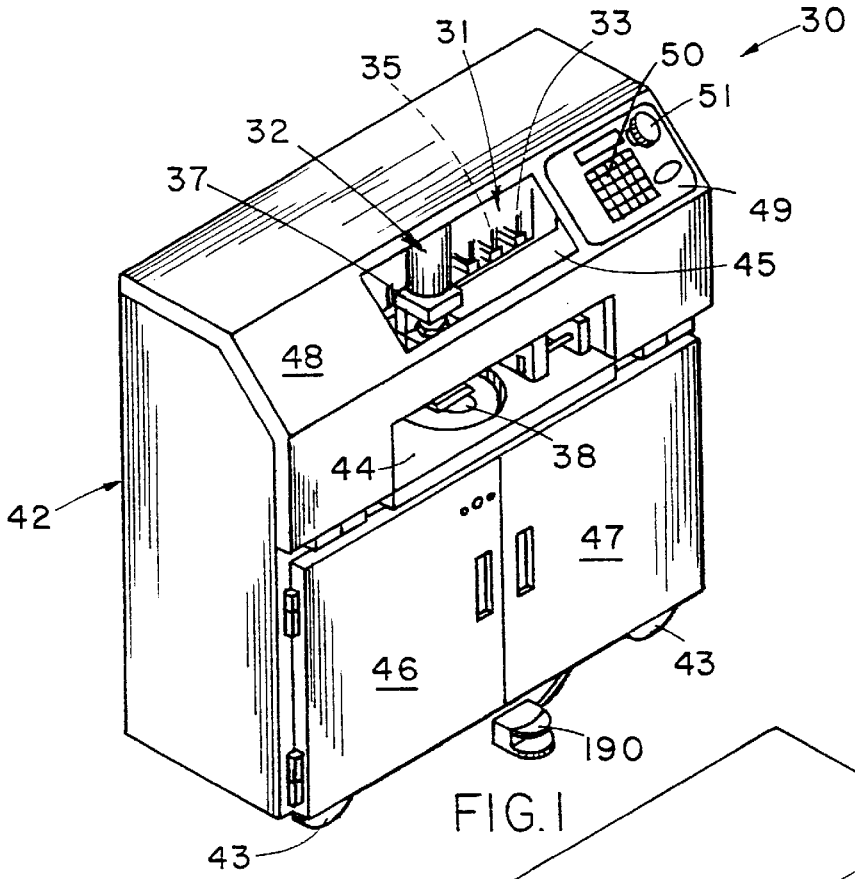
FIG. 1 is a perspective view of a document trimming apparatus embodying the present invention.

For the purposes of description herein, the terms "upper," "lower," "right," "left," "rear," "front," "vertical," "horizontal," and derivative thereof shall related to the invention as oriented in FIG. 1 with the front of the apparatus being generally at the right and outward from the paper. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 10:
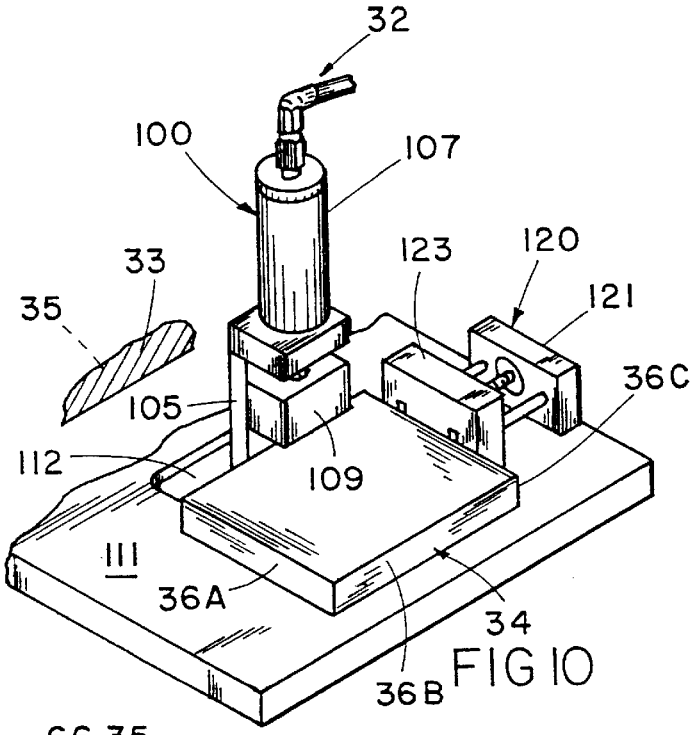
FIG. 10 is a perspective view of the upper end of the document positioning mechanism and the table top of the document trimming apparatus shown in FIG. 1 immediately after loading a document comprising a stack of papers to be trimmed into the apparatus, the transport clamp being in the up position and the side block being in the extended position.
Figure 11:
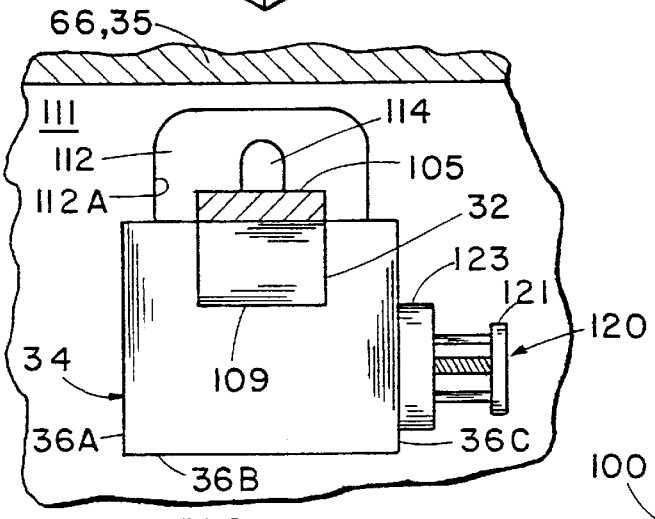
FIG. 11 is a plan view partially in cross section of the positioning mechanism and document as shown in FIG. 10.

A document trimming apparatus 30 (FIG. 1) embodying the present invention includes a document trimming mechanism 31 and a document positioning mechanism 32. The document trimming mechanism 31 includes a trimmer clamp 33 for holding a document 34 (FIG. 10) comprising a stack of papers or sheets while being trimmed and a knife 35 (FIGS. 1 and 4) for trimming an edge of the stack of sheets 34 (FIG. 10). The document positioning mechanism 32 (FIG. 1) includes a transport holder 37 for securely holding the document (34) during transport and further includes a carrier 38 movably supporting the transport holder 37 for translational and rotational movement relative to the document trimming mechanism 31. The document positioning mechanism 32 is adapted to successively position the orthogonal edges 36A, 36B, and 36C (FIG. 10) of the document 34 proximate the knife 35 FIG. 5 for trimming. A controller 39 (FIG. 1) is operably connected to the document trimming mechanism 31 and the document positioning mechanism 32 to control the sequence of operations. In a preferred embodiment, stepper motors 96 and 204 are used in the document positioning mechanism 32 to control angular rotation and the distance of translation, although it is contemplated that other control means can be used. The apparatus 30 advantageously provides a safe, efficient, and mechanically non-complex structure facilitating trimming documents in an effective manner.

Figure 2:
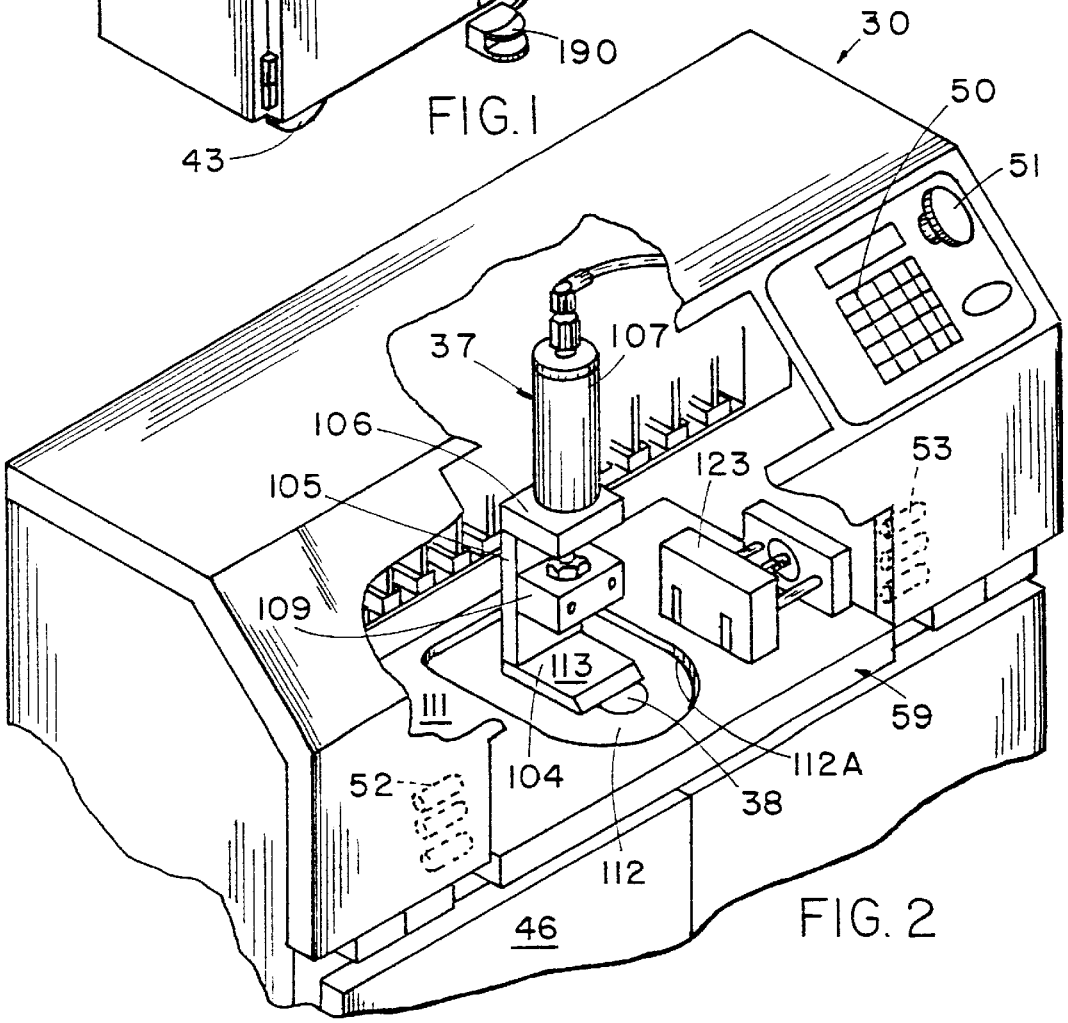
FIG. 2 is an enlarged fragmentary perspective view of the front opening and surrounding area of the document trimming apparatus shown in FIG. 1.

More particularly, document trimming apparatus 30 (FIG. 1) includes a cabinet 42 movably supported by castors 43. Cabinet 42 defines a front access opening 44 for input of documents 34 to be trimmed, and a viewing window 45 located above front opening 44. A pair of opposing front doors 46 and 47 are located on the front of cabinet 42. Doors 46 and 47 extend from the bottom of cabinet 42 about two thirds of the way up the front of cabinet 42. Front opening 44 is located immediately above the top of doors 46 and 47, and window 45 is spaced above front opening 44 on a rearwardly angled wall section 48 at the top of the cabinet 42. A control panel 49 including a keyboard 50 and an emergency stop button 51 is located to the right of window 45. Three photo electric emitter eyes 52 (FIG. 2) are located on one side of front opening 44, and three photo detector eyes 53 are located on an opposite side of front opening 44 for receiving light beams emitted from emitter eyes 52. Detector eyes 53 are operably connected to controller 49 to stop the automatic operation of document trimming apparatus 30 if an object, such as an operator's hand, is extending into the operating area of document trimming apparatus 30.

Figure 3:
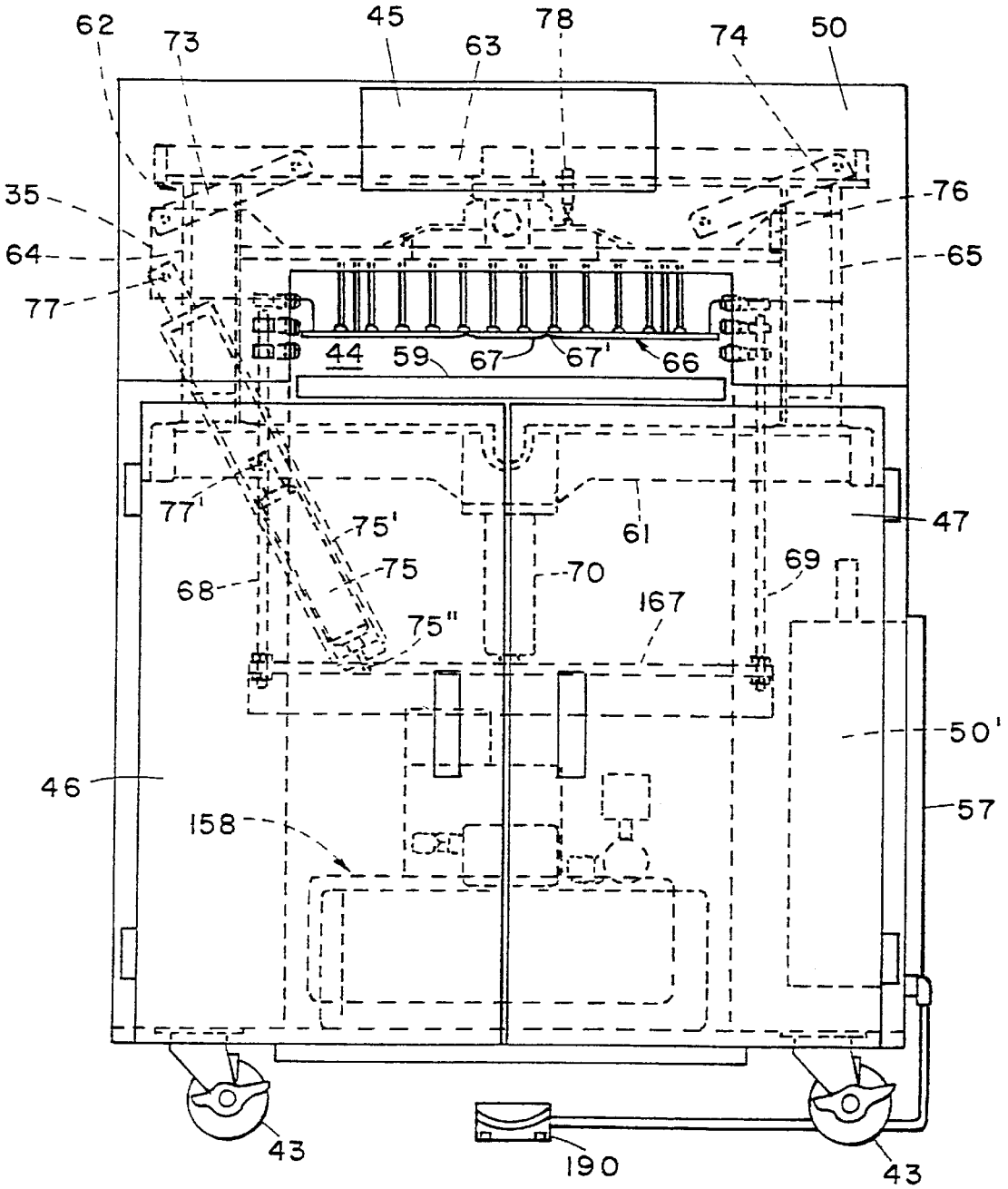
FIG. 3 is a front elevational view of the document trimming apparatus shown in FIG. 1.

The document positioning mechanism 32 (FIG. 4) is located generally behind the front opening 44 to receive documents "handed" to it, and the document trimming mechanism 31 is located generally behind the document positioning mechanism 32. The hydraulic and pneumatic systems 158 and 180 are located generally behind doors 46 and 47 below document trimming mechanism 31 and document positioning mechanism 32, and the electrical system is located on generally the right side of cabinet 42 adjacent keyboard 50 and also in electric box 50' (FIG. 3). A top access door 54 (FIG. 4) is located on cabinet 42 and a gas cylinder 55 is attached to the top access door 54 to assist in opening the top door 54 and to hold the top door 54 in the open position once pivoted to the open position. Rear access doors 56 and side access door 57 are also provided for accessing components within cabinet 42.

A table 59 (FIG. 4) extends generally horizontally within cabinet 42 from the bottom of front opening 44 rearwardly and defines a rear edge 60 spaced from the rear of cabinet 42. A structural base 61 is secured between the sides of cabinet 42. Base 61 is located immediately below table 59 under table rear edge 60 and supports the table 59. A structural arch 62 is positioned over base 61 and includes a structural cross member 63 (FIG. 3) located above and spaced from base 61, and further includes a pair of structural legs 64 and 65 that are secured to the ends of base 61. A trimmer clamp plate 66 is located generally above table rear edge 60 and includes a planar bottom surface 67 for pressing document 34 against table 59 (and in turn against base 61) while the document (34) is being trimmed. Notches 67' in planar bottom surface 67 provide relief for receiving the spine or bound edge of a book or document to prevent crushing the spine when clamp plate 66 is lowered. Trimmer clamp plate 66 includes tabs in its opposing ends for engaging channels in arch legs 64 and 65 to guide the vertical movement of clamp late 66. A clamp bar 167 is located below table 59 and base 61. Trimmer clamp bar 167 is connected to clamp plate 66 by tie rods 68 and 69. A trimmer clamp actuator 70 is connected between the bottom of base 61 and the top of trimmer clamp bar 167. Actuator 70 is a hydraulic cylinder, although it is contemplated that alternative actuators could also be used.

Front and rear knife guides 71 and 72 (FIG. 4) extend vertically and from side-to-side between arch legs 64 and 65 (FIG. 3). Knife 35 (FIG. 3) is bolted to a knife bar or carrier 35' that is movably attached to arch cross member 63 by a pair of links 73 and 74 in a parallelogram-type arrangement. A knife actuator bracket 75' is operably connected to the left end of knife bar 35' at location 77 and extends to a location 75" below base 61. Knife actuator 75 is connected between location 75" on bracket 75' and location 77' on base 61. When knife actuator 75 is operated, knife 35 swings arcuately downwardly and to the right as shown in FIG. 3 on links 73 and 74 with a slicing movement along a cutting line across table 59. Specifically, once clamp plate 66 engages a document (34) and builds pressure on the document, knife actuator 75 operates to move knife 35 slidingly through document 34. A proximity sensor 76 is located on arch 62 to indicate the knife down position of knife 35. Another proximity sensor 78 indicates the up position of clamp plate 66.

The document positioning mechanism 32 (FIGS. 6–8) includes a carrier 38 carrying a translator 88. Carrier 38 comprises a carrier plate 90 operably mounted under table 59 on linear shafts 91 and 92. Shafts 91 and 92 are mounted to table 59 and spaced from the bottom side of table 59 by support blocks 93. A lead screw 94 extends through a nut on a flange 95 attached to carrier plate 90. A stepper motor 96 is operably connected to lead screw 94 for rotating same. Stepper motor 96 is mounted to table 59 by a bracket 97. Stepper motor 96 is controller by controller (39) to provide a known translational movement for document 34.

The transport holder 37 of document positioning mechanism 32 includes a rotator 100 (FIGS. 8–9) operably mounted on carrier plate 90 for controlled rotational movement of document 34. Rotator 100 includes a bottom shaft 102, and carrier 90 plate supports a split collar bearing 101 that rotatably supports the lower end of shaft 102 of rotator 100 which includes stepper motor 204, pulleys 201, 202, and belt 203, all of which are supported on carrier plate 90. A C-shaped intermediate frame extends from bottom shaft 102, and includes a first horizontal leg 104, a vertical leg 105, and a second horizontal leg 106. A clamp cylinder or actuator 107 is mounted vertically on second horizontal leg 106. Actuator 107 includes an extensible rod 108 that can be extended along arrow "B". A foot 109 on the end of rod 108 includes a planar lower surface 110 configured to press document 34 against first leg 104. First leg 104 is a planar plate having a width and depth chosen to securely support document 34 without leaving indentations or marks on document 34 after the document is clamped against first leg 104 by foot 109/clamp actuator 107. The upper surface 111 of table 59 includes a shallow depression 112 (FIG. 2) having the thickness of first leg 104. Thus the upper surface 113 of first leg 104 is substantially co-planar with the upper surface 111 of table 59. Notably, document 34 (FIG. 10) is substantially larger in area than first leg 104. Nonetheless, when document 34 is resting on first leg 104, document 34 is held substantially flat since it is supported by co-planar surfaces 111 and 113 of table 59 and first rotator leg 104, respectively. Depression 112 (FIG. 6) has a width and fore-to-aft dimension sufficiently large to allow first leg 104 to be rotated about shaft 102 (FIG. 9) and translated linearly along a slot 114 in table 59 without engaging the edges 112A of depression 112.

A retractable locator 120 (FIGS. 6–8) is operably mounted to a side of table 59. Locator 120 includes a side support block 121 which slideably supports a guide rod 122. A side alignment block 123 is attached to the end of guide rod 122. A screw 124 extends through support block 121 and is operably connected to a stepper motor 125. Vertical leg 105 on rotator 100 has a predetermined width and side alignment block 123 also has a predetermined width so that a document 34 placed against leg 105 and block 123 (FIG. 10) takes on a predetermined aligned position. By controlling stepper motor 125 (FIG. 7), side alignment block 123 is extendable along arrow "A" to a desired position so that document 34 is initially grasp by document positioning mechanism 32 in a known location, with the edges 36 of the document 34 also being in a known position relative to the vertical axis defined by rotator shaft 102.

A chute 140 (FIG. 4) is attached to the rear of table 59 to convey waste paper trimmed from document 34 into a disposal container at the rear of cabinet 42. A cover guard 140' protects chute 140. A tilt table 141 is pivotally mounted to the rear of table 59. Tilt table 141 is moveable between a raised position "C" (FIG. 5) that allows waste trimmed from the document (34) to slide along chute 140 to the waste container, and further is moveable to a lowered position where the stack of sheets of paper trimmed from the document 34 are to be saved. For example, in the lowered position, a document (34) can be bisected or cut in half to separate two manuals which are printed on a single stack of paper.

Tilt table 141 (FIG. 6) is pivotally mounted to table 59 by pivot pins 143 and 144. A pneumatic actuator 145 is operably secured between tilt table 141 and table 59 for automatically raising and lowering tilt table 141. Side guards 146 and 147 are secured to the top of tilt table 141 to prevent excessive skewing of the loose papers comprising a document 34. A pusher 148 is mounted to the rear of tilt table 141. Pusher 148 includes a document-engaging pusher block 149 and an actuator 150 including an extensible rod for moving pusher block 149.

Figure 18:
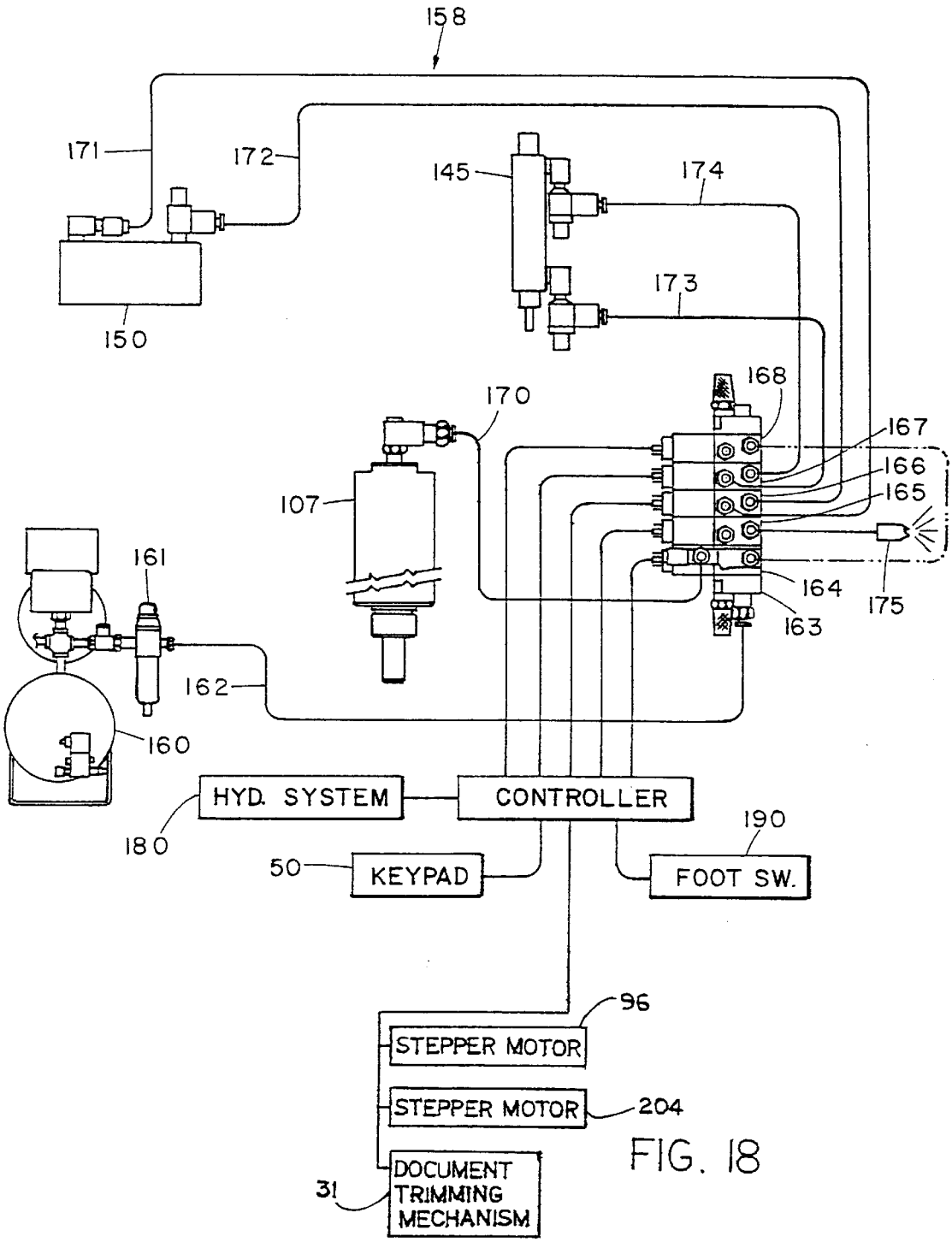
FIG. 18 is a schematic view of the pneumatic system of the document trimming apparatus.

The pneumatic system 158 (FIG. 18) of document trimming apparatus 30 includes an electrically operated air compressor 160 and pressure regulator and filter 161. A supply pipe 162 extends from regulator/filter 161 to manifold 163. A plurality of electrically operated valves 164–168 are operably mounted to manifold 163, and a plurality of tubes 170–174 extend from the valves 164–168 for communicating air pressure to the rotator clamp actuator 107, to opposing ends of tilt table lift actuator 145, to opposing ends of tilt table pusher actuator 150, and to a nozzle 175 for providing a blast of air for moving trimmed scrap from knife 45.

Figure 4:
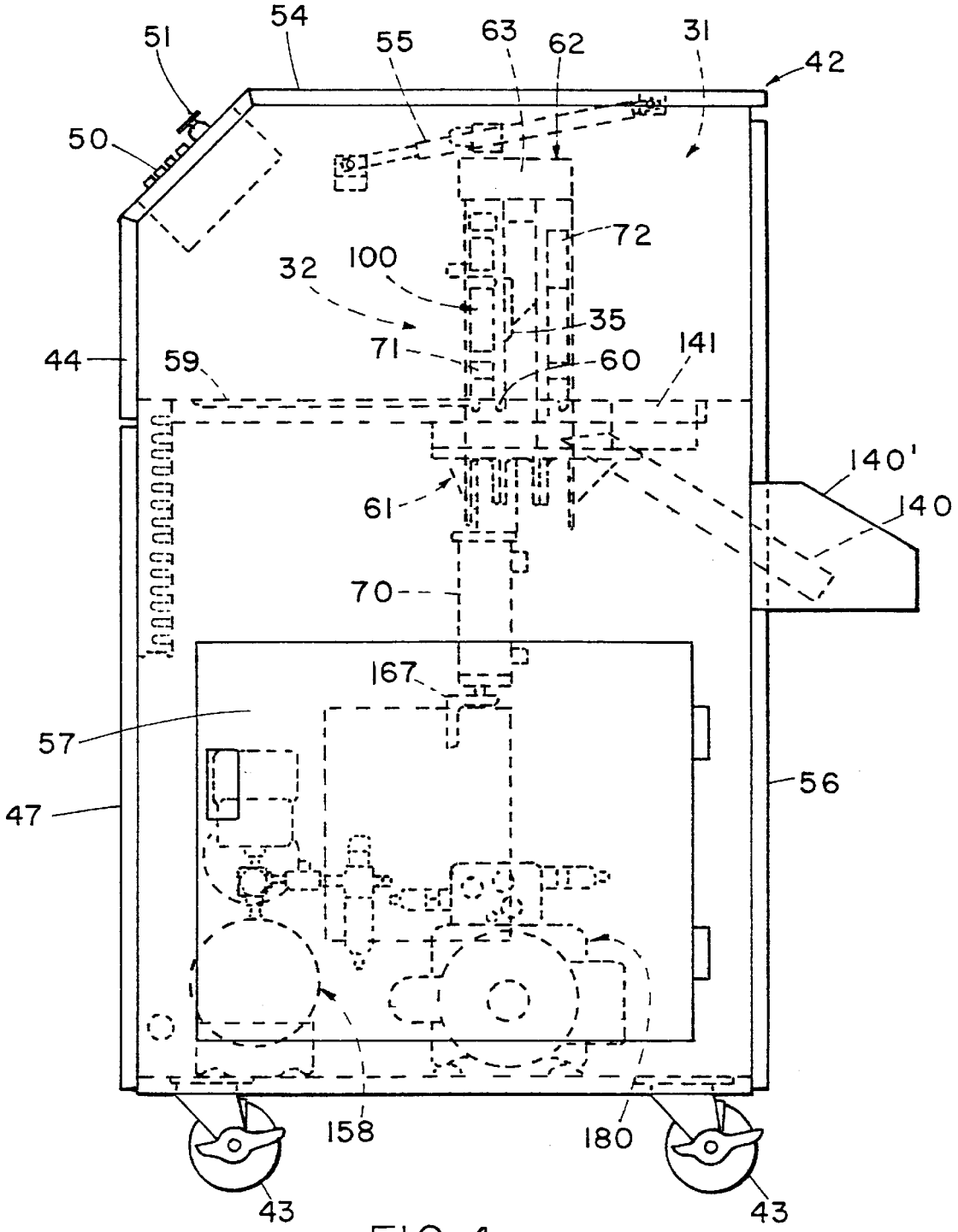
FIG. 4 is a side elevational view of the document trimming apparatus shown in FIG. 1.
Figure 5:
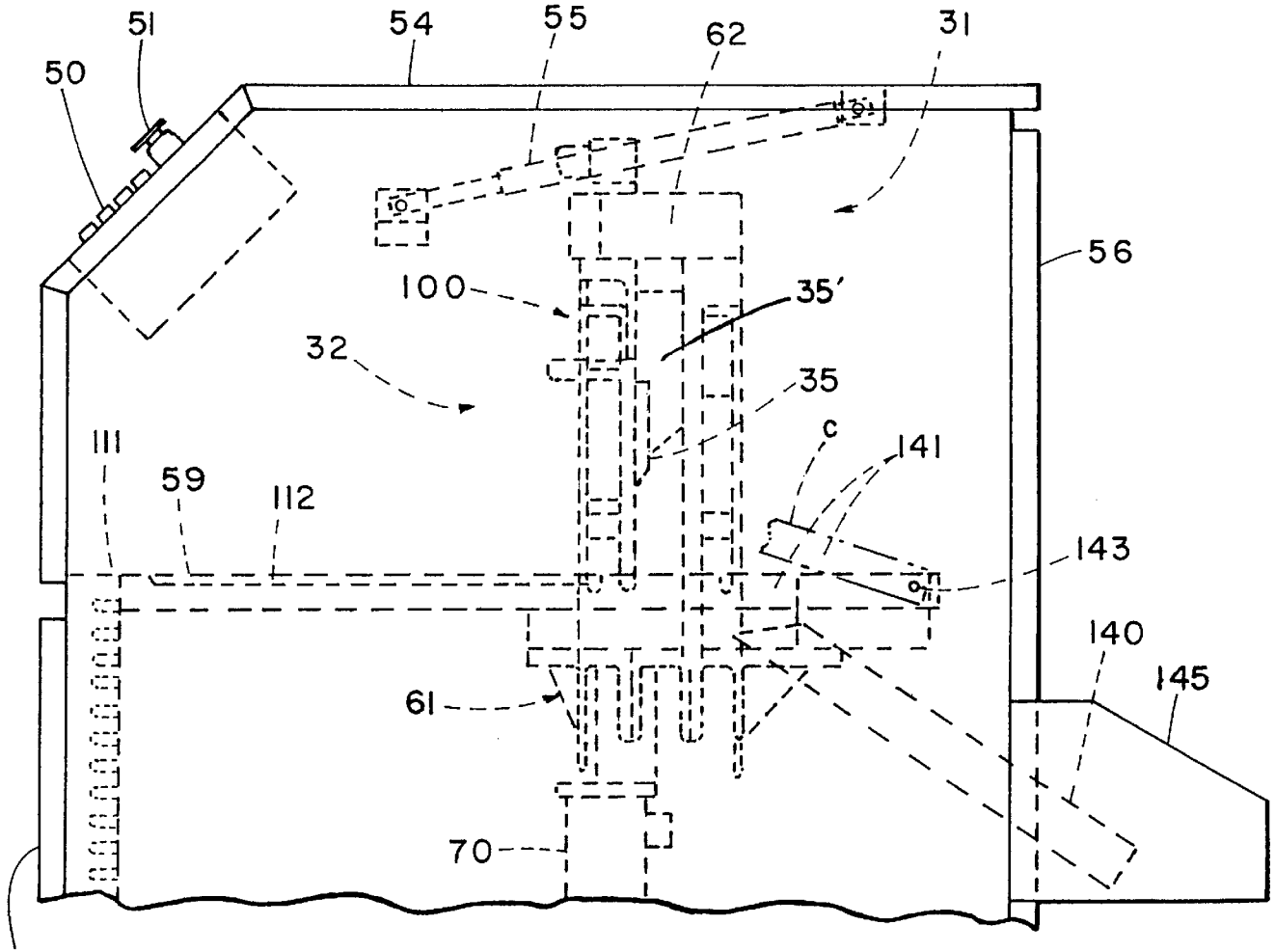
FIG. 5 is an enlarged fragmentary side view of the upper half of the document trimming apparatus shown in FIG. 4.

Document trimming apparatus 30 also includes a hydraulic system 180 (FIG. 4). Hydraulic system 180 includes a hydraulic pump, a fluid reservoir, and a manifold for distributing pressurized hydraulic fluid. A plurality of electrically operated valves (not specifically shown) are operably connected to the manifold, and pairs of hydraulic lines extend to each of the hydraulically operated actuators such as the trimmer clamp actuator 70 and the knife actuator 75.

The programmable controller 39 is operably connected to each of the pneumatic valves 164–168 and to the hydraulic valves (not specifically shown), and is programmed for different operations. In particular, the programmable controller 39 can be programmed to selectively trim one, two, or three sides 36 of document 34, or can be programmed to cut a document in half. In each mode, the size of the document 34 can be programmed into the controller so that edges are trimmed at a desired location. A foot switch 190 is operably connected to controller 39 for manually initiating a cycle of apparatus 30.

Figure 12:
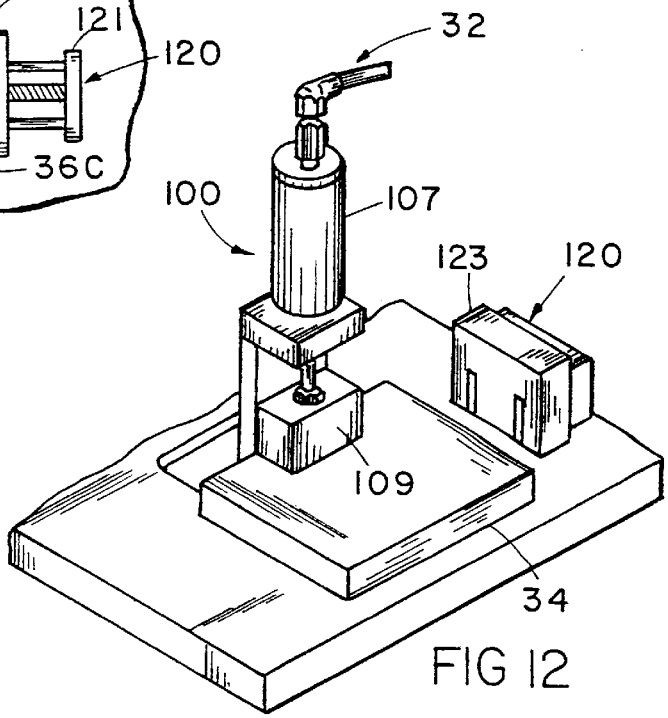
FIG. 12 is a perspective view of the document trimming apparatus shown in FIG. 10 including the document, but with the transport clamp being in the clamped position and the side block being in the retracted position.
Figure 13:
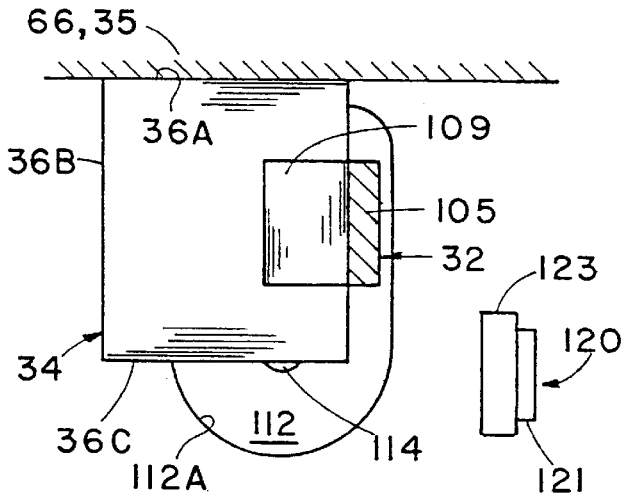
FIG. 13 is a plan view partially in cross section of the positioning mechanism and document, the document being rotated to a first position ready for trimming a first edge.
Figure 14:
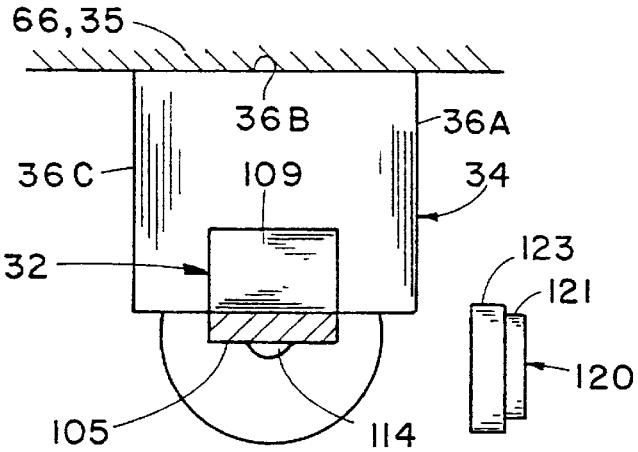
FIG. 14 is a plan view partially in cross section of the positioning mechanism and document, the document being rotated to a second position ready for trimming a second edge.
Figure 15:
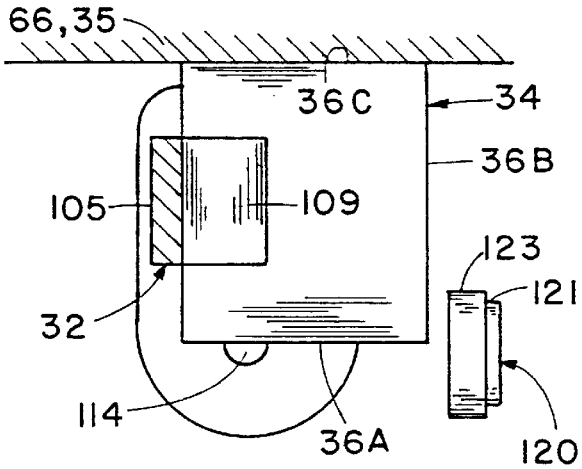
FIG. 15 is a plan view partially in cross section of the positioning mechanism and document, the document being rotated to a third position ready for trimming a third edge.
Figure 16:
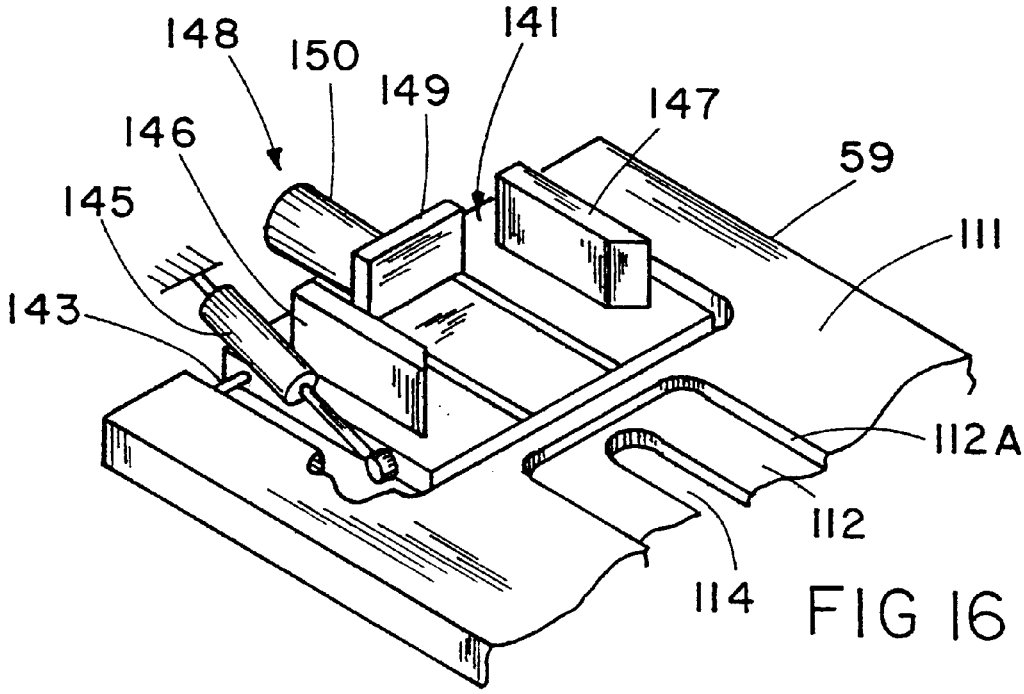
FIG. 16 is a fragmentary perspective view of the tilt table, the tilt table being in the lowered position for receiving and returning a half of a document after the document is cut in half.
Figure 17:
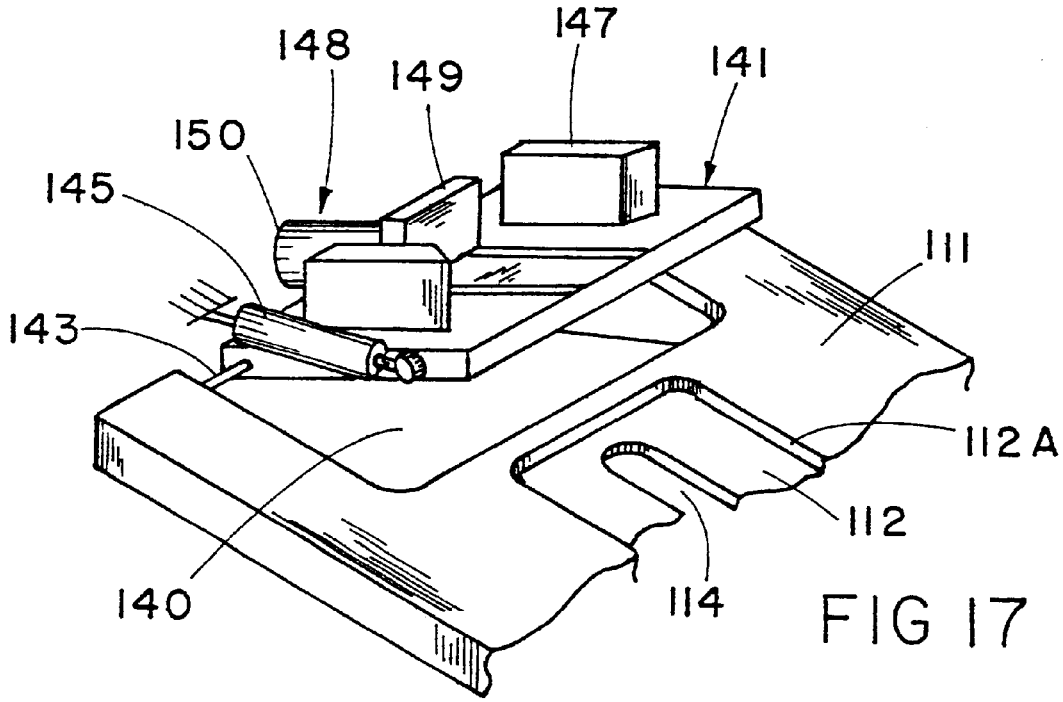
FIG. 17 is a fragmentary perspective view of the tilt table, the tilt table being in the raised position for allowing waste from a trimmed document to slide down a chute.

To operate document trimming apparatus 30, an operator initially selects an operation to be performed by apparatus 30 by use of key pad. A document 34 is the positioned against rotator vertical leg 105 and retractable support block 121 on table 59 (FIG. 10). Once the document 34 is properly positioned, foot 109 is lowered to grasp document 34, and side block 121 is retracted (FIG. 12). Then, rotator 100 is rotated and translator 88 translated to place document 34 in a desired position for trimming (FIG. 13). Knife 35 is then actuated to trim the document 34. The waste paper falls away through chute 140. Rotator 100 and translator 88 are again actuated to position the document 34 in a second position (FIG. 14) and a third position (FIG. 15) for trimming. Rotator 100 then returns to a home or start position (FIG. 10) where document 34 can be removed. Notably, in the optional mode where document 34 is cut in half, after the first half of the document is removed by operator, the second half is pushed off of tilt table 141 onto table 59 by pusher 148 where rotator 100 grasps the second half. The "second" document is then moved it to the "home" position by positioning mechanism 32.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A document trimming apparatus for trimming documents having edges comprising:

a table having sides, a top surface with a depression located substantially between said sides of said table and a slot located within said depression and extending through said table;

a document cutting mechanism, operatively connected to the table, including a clamp holding a document while the document is being cut and a knife located above said table and defining a cutting line for cutting the document;

a document positioning mechanism including a transport holder having a support member securely holding the document during transport, said support member being located in said depression, said document positioning mechanism further including a carrier movably supporting said transport holder for translational movement in said slot and translational and rotational movement of said support member in said depression relative to said document cutting mechanism, said document position mechanism positioning the document at predetermined positions proximate the cutting line.

2. A document trimming apparatus as defined in claim 1 including at least one actuator located underneath said table and operably connected to said document positioning mechanism for actuating said document positioning mechanism.

3. A document trimming apparatus as defined in claim 2 including a controller for controlling said at least one actuator.

4. A document trimming apparatus as defined in claim 1 including a cabinet on wheels, said document cutting mechanism and said document positioning mechanism being located in said cabinet.

5. A document trimming apparatus as defined in claim 1 wherein said document positioning mechanism includes an alignment block located at one side of said transport holder for locating the document when the document is initially placed in the document positioning mechanism, said alignment block being retractable.

6. A document trimming apparatus as defined in claim 1 wherein said transport holder includes a clamp.

7. A document trimming apparatus as defined in claim 1 wherein said carrier includes a translator linearally moving said holder along said slot and a rotator mounted on said translator, said rotator rotating said transport holder while said translator moves said transport holder.

8. A document trimming apparatus as defined in claim 1 wherein said document positioning mechanism includes a stepper motor operably connected to said transport holder for moving said document positioning mechanism a desired translational distance.

9. A document trimming apparatus ad defined in claim 8 wherein said document positioning mechanism includes a second stepper motor operably connected to said transport holder for rotating said document positioning mechanism a desired rotational angular distance.

10. A document trimming apparatus as defined in claim 1 including a programmable controller operably connected to said document cutting mechanism and said document positioning mechanism for controlling the operation of said mechanisms.

11. A document trimming apparatus as defined in claim 1 wherein said top surface supports said document with the edges of the document extending laterally from the transport holder, said top surface being located on a plane, said transport holder including a clamp including said support member as a horizontal clamping member movably located in the depression, the horizontal clamping member having a second top surface, the top surface of the table and the second top surface of said clamping member being substantially co-planar.

12. A document trimming apparatus as defined in claim 1 wherein said clamp includes a guillotine-type clamping bar.

13. A document trimming apparatus as defined in claim 1 wherein said document trimming apparatus includes knife-supporting structure, and said knife is operably connected to said knife-supporting structure by links so that said knife moves along an arcuate path to trim the document.

14. A trimming apparatus for trimming a stack of sheets having edges, comprising:

a document cutting mechanism including a table and a clamp holding a document while the document is being cut and a knife located above said table and defining a cutting line for cutting the document;

said table having a top with an elongated slot extending through said top and in a direction substantially perpendicular to said cutting line;

a stack holder positioned above said slot of said table for holding a stack of sheets;

a rotator mechanism located under said table and having a portion extending through said slot for rotating said stack holder;

a translator mechanism operatively connected to said stack holder and located under said table for movably translating said stack holder along said slot; and said stack holder being rotatable by said rotator mechanism and movable by said translator mechanism to successively position edges of the stack of sheets on the table for sequentially trimming the edges of the stack of sheets by said knife.

15. A trimming apparatus as defined in claim 14 wherein said stack holder includes a clamp for holding the stack of sheets as the stack of sheets is rotated and moved.

16. A trimming apparatus as defined in claim 15 including a controller operably connected to said stack holder, said rotator mechanism, said translator mechanism and said document cutting mechanism for controlling the operation of said stack holder, said rotator mechanism, said translator mechanism and said document cutting mechanism.

17. A trimming apparatus as defined in claim 15 including actuators connected to said rotator mechanism and said translator mechanism, said actuators including stepper motors.

18. A trimming apparatus as defined in claim 14 wherein said translator mechanism includes a linearly movable carriage and said rotator mechanism is mounted on said linearly movable carriage.

19. A trimming apparatus as defined in claim 14 wherein a retractable block is provided on said table, said retractable block having a first alignment surface, said stack holder including a second alignment surface; said first and second alignment surfaces providing a pair of orthogonally related surfaces defining an initial start position for the document.

20. A trimming apparatus as defined in claim 14 wherein said table includes a main table for supporting edges of the stack of sheets that extend laterally from the stack holder, and including a tilt table that is movable between a first position for receiving material cut from the stack of sheets and a second position providing a gap between said tables for receiving material trimmed from the stack of sheets thereby permitting trimmed material to fall into a waste container.

21. A trimming apparatus as defined in claim 14 including a cabinet having wheels for portably supporting said stack holder, said rotator mechanism, said translator mechanism and said document cutting mechanism.

22. A document cutting apparatus comprising:

a document cutting mechanism, operatively associated with a main table, including a clamp, for holding a document while the document is being cut, and a knife, defining a cutting line for cutting the document;

a document positioning mechanism, operatively associated with said main table, including a transport holder, for securely holding the document during transport, and a carrier for movably supporting said transport holder for translational and rotational movement relative to said document cutting mechanism;

said main table having a first top surface located on a plane and supporting parts of the document that extend laterally from the transport holder;

a secondary table positioned behind said main table to move relative to said main table between first and second positions, wherein said secondary table has a second top surface;

an actuator operatively associated with the secondary table for moving said secondary table to either of said first and second positions;

a controlling means for controlling said document positioning mechanism such that the document is positioned at predetermined positions relative to the cutting line, wherein at least one of said predetermined positions is an edge trimming position and at least another of said positions is a separating position in which said knife cuts said document into two separate usable parts;

said second top surface of said secondary table is spaced a distance away from said first top surface of the main table when in said edge trimming position;

said second top surface of said secondary table is located on said plane of said first top surface of the main table with an edge of said second top surface closely adjacent an edge of said first top surface when in said separating position;

a pusher operatively associated with said secondary table for pushing one usable part of said two separate usable parts of said document located on the second top surface of said secondary table onto said first top surface of said main table; and said controlling means further comprises means for controlling said actuator and pusher such that; said secondary table is moved to said first position when said document positioning mechanism is in the edge trimming position to provide an opening for receiving material trimmed from the document whereby said trimmed material falls through said opening into a waste container positioned below the tables; said secondary table is moved to said second position when said document positioning mechanism is in said separating position whereby one of said two separate usable parts of said document is received on said second top surface of said secondary table; and said pusher moves said one usable part cut from said document from said secondary table back to said main table only after said document is cut and separated into two parts and when said secondary table is in said second position whereby allowing the one usable part to be removed from said main table.

* * * * *